US009115932B2

(12) United States Patent
McDaniel

(10) Patent No.: US 9,115,932 B2
(45) Date of Patent: Aug. 25, 2015

(54) EDGE-LIT INDICATOR FOR AN APPLIANCE DISPENSER

(75) Inventor: Aaron Matthew McDaniel, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1391 days.

(21) Appl. No.: 12/850,436

(22) Filed: Aug. 4, 2010

(65) Prior Publication Data

US 2012/0031124 A1 Feb. 9, 2012

(51) Int. Cl.

| | |
|---|---|
| ***G01D 11/28*** | (2006.01) |
| ***F25D 23/12*** | (2006.01) |
| ***F25D 27/00*** | (2006.01) |

(52) U.S. Cl.

CPC ..... *F25D 23/126* (2013.01); *F25D 27/00* (2013.01); *F25D 2327/001* (2013.01)

(58) Field of Classification Search

CPC . F25D 23/126; F25D 27/00; F25D 2327/001; F25D 2400/36; F25D 27/005; F25B 29/00; F25B 45/00; F21W 2313/305; F21V 33/0044; F21V 23/0442; G09F 13/10; G09F 13/12

USPC ..... 62/125, 127, 389; 362/92–94, 96, 802, 362/23.12, 23.19; 40/553, 581, 442, 444; 225/55–69

See application file for complete search history.

(56) References Cited

U.S. PATENT DOCUMENTS

| | | | | |
|---|---|---|---|---|
| 7,040,110 | B2 * | 5/2006 | Nowak | 62/264 |
| 2008/0066356 | A1 | 3/2008 | Miller et al. | |
| 2008/0204268 | A1 | 8/2008 | Dowling et al. | |
| 2010/0319383 | A1 * | 12/2010 | Kim | 62/264 |

FOREIGN PATENT DOCUMENTS

| | | | | |
|---|---|---|---|---|
| WO | WO2008051001 | A1 | 5/2008 | |
| WO | WO 2009104858 | A1 * | 8/2009 | F25D 23/02 |
| WO | WO 2009125911 | A1 * | 10/2009 | F25C 5/00 |

* cited by examiner

*Primary Examiner* — Frantz Jules
*Assistant Examiner* — Azim Abdur Rahim
(74) *Attorney, Agent, or Firm* — Dority & Manning, P.A.

(57) ABSTRACT

An indicator for a dispenser is disclosed. The indicator includes at least one display layer having at least one display surface surrounded by at least one edge surface, the at least one display layer being transparent in a direction of the at least one edge surface; at least one light source configured to transmit light through the at least one display layer in the direction of the at least one edge surface; and at least one pattern portion disposed in the at least one display surface such that light from the at least one light source is redirected through the at least one pattern portion.

13 Claims, 12 Drawing Sheets

EDGE-LIT INDICATOR FOR AN APPLIANCE DISPENSER

BACKGROUND OF THE INVENTION

The present disclosure generally relates to an edge-lit indicator for an appliance dispenser and more particularly to an ice and water dispenser for a refrigerator.

Many refrigerators have built in dispensers for ice and/or water. Often located in a refrigerator or freezer door, a dispenser is typically configured to dispense crushed or cubed ice directly from a built in ice maker, and to dispense water from a connection to a water line that feeds the water dispenser and ice maker. Typically, a receptacle such as a glass is pressed against a built in paddle beneath the dispenser, dropping ice and/or water into the receptacle. The paddle may be lit, e.g., via LED, for easy location by the user in low-light situations. Dispensers may have more than one paddle to facilitate dispensing different items. For example, a dispenser may have three paddles side by side configured to dispense water, crushed ice and ice cubes, respectively.

Other dispensers may have one paddle that may be configured to dispense a number of different items in different modes depending on a user input such as a button or switch. Typically, the dispenser has a display that may indicate the current mode prior to dispensing the respective item, for example, by displaying the mode, e.g., via an LED, when the display is touched. This configuration has the disadvantage of requiring a user to perform an additional physical step before verifying the mode. These displays may also require at least one LED for each mode, and each indicator for each respective mode is in a different location of the display. In addition, the display may have other, unrelated LEDs that make it more difficult for a user to quickly locate information about the current dispenser mode. LED backlit displays may also exhibit uneven light distribution within an indicator, or else require multiple LEDs for each indicator. Other displays have indicators that are always on so as not to require input from the user prior to displaying the mode, but still have all the other drawbacks listed above.

Accordingly, it would be desirable to provide a system that addresses at least some of the problems identified above.

BRIEF DESCRIPTION OF THE INVENTION

According to one example embodiment, a dispenser indicator comprises at least one display layer having at least one display surface surrounded by at least one edge surface, the at least one display layer being transparent in a direction of the at least one edge surface; at least one light source configured to transmit light through the at least one display layer in the direction of the at least one edge surface; and at least one pattern portion disposed in the at least one display surface such that light from the at least one light source is redirected through the at least one pattern portion.

According to another example embodiment, a dispenser for a refrigerator comprises at least one indicator comprising: at least one display layer having at least one display surface surrounded by at least one edge surface, the at least one display layer being transparent in a direction of the at least one edge surface; at least one light source configured to transmit light through the at least one display layer in the direction of the at least one edge surface; and at least one pattern portion disposed in the at least one display surface such that light from the at least one light source is redirected through the at least one pattern portion.

According to yet another example embodiment, a refrigerator comprises a dispenser; and an indicator for the dispenser. The indicator includes a display layer having a display surface surrounded by an edge surface, the display layer being transparent in a direction of the edge surface; a light source configured to transmit light through the display layer in the direction of the edge surface; and a pattern portion disposed in the display surface such that light from the light source is redirected through the pattern portion.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
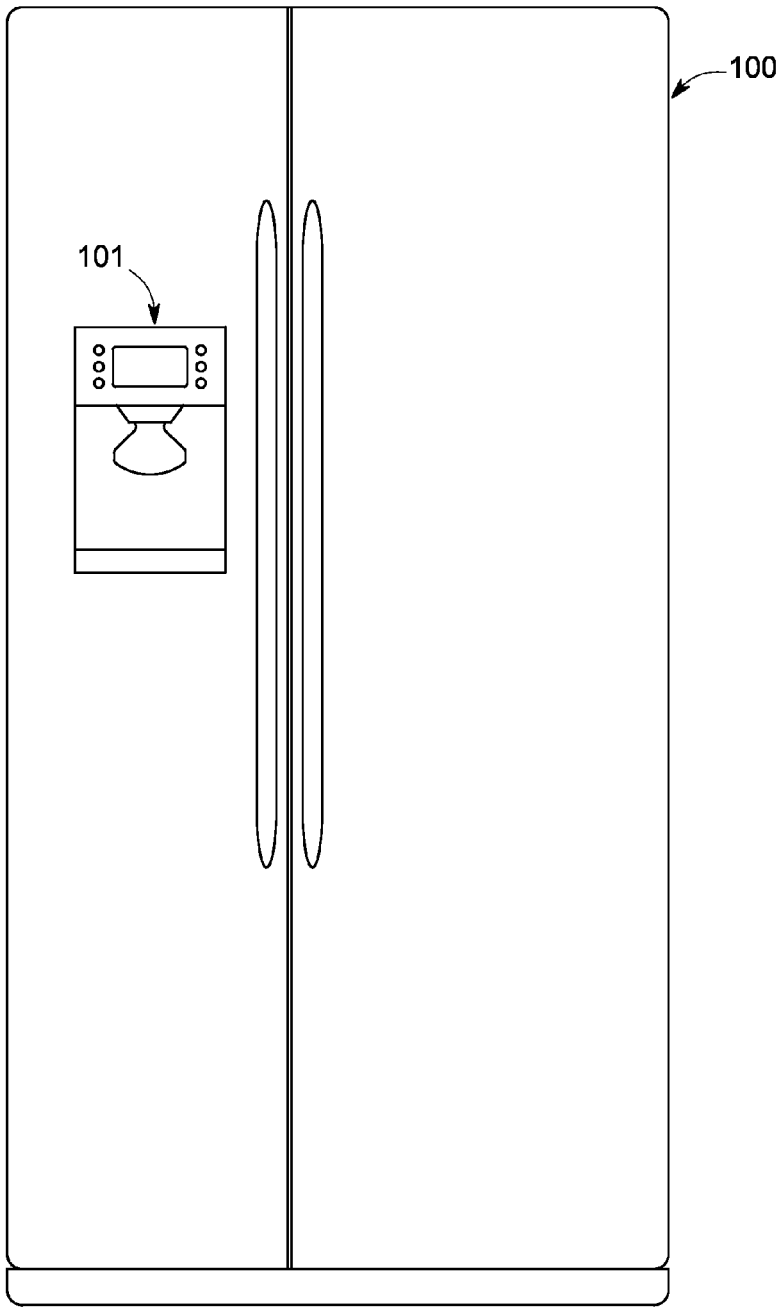
FIG. 1 illustrates a refrigerator according to one or more embodiments.

FIG. 1 illustrates a refrigerator 100 having side-by-side doors in which the freezer door contains an ice and water dispenser 101 according to a number of different embodiments.

Figure 2A:
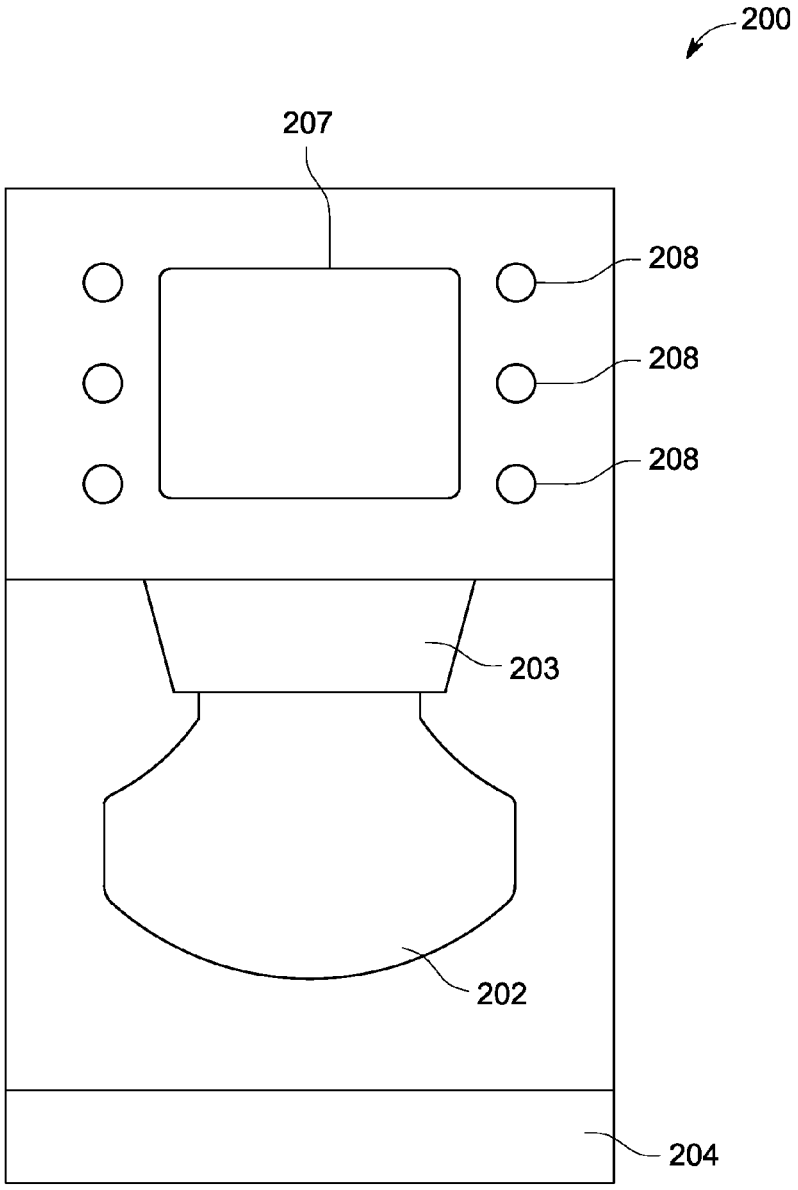
FIG. 2a PRIOR ART
FIGS. 2*a* and 2*b* illustrate front and side views of a prior art dispenser.

FIG. 2*a* is an enlarged front view of an example prior art dispenser 200. Dispenser 200 contains a control panel 201 having a display 207 and buttons 208. Below the control panel 201 is a dispenser chute 203 arranged to drop ice and/or a water spout 230 arranged to dispense water. A spill tray 204 may be located below the chute to catch small overflows, splashes and spills. The paddle is connected to the dispenser 200 via one or more hinges 205 and is typically biased at an angle away from a rear surface of the dispenser 200. The dispenser may also contains a sensor 206 that detects movement of the paddle 202 toward the rear surface of the dispenser 200, and may include a light source 209 for illuminating an area within and/or around the dispenser.

Figure 2B:
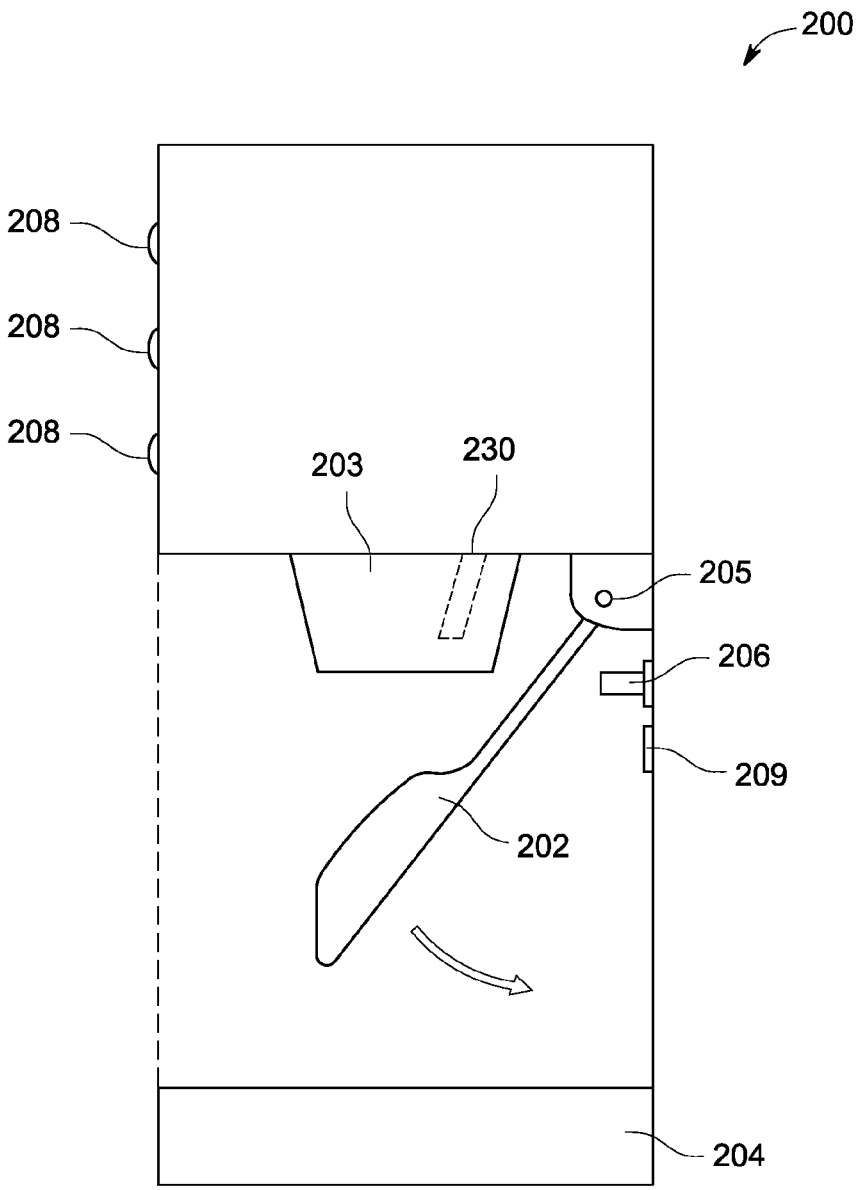
FIG. 2b PRIOR ART

FIG. 2*b* disclose a side view of the dispenser 200. As discussed above, the paddle may be biased away from the rear surface of the dispenser 200. A glass or other receptacle may be moved underneath the chute 203, displacing the paddle 202. The sensor 206 detects movement of the paddle 202 toward the rear surface of the dispenser 201 and activates the ice and/or water dispensing function of the dispenser 200.

Figure 3A:
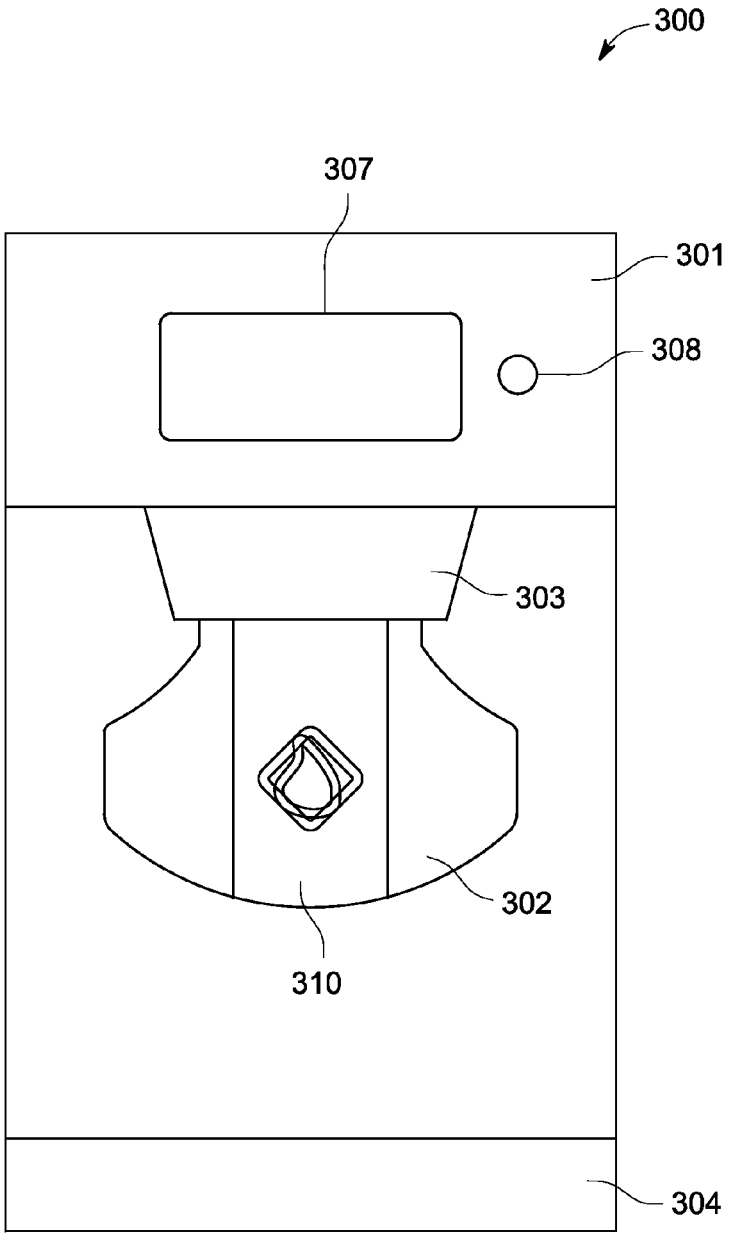
FIGS. 3*a* and 3*b* illustrate front and side views of a dispenser according to an example embodiment.
Figure 3B:
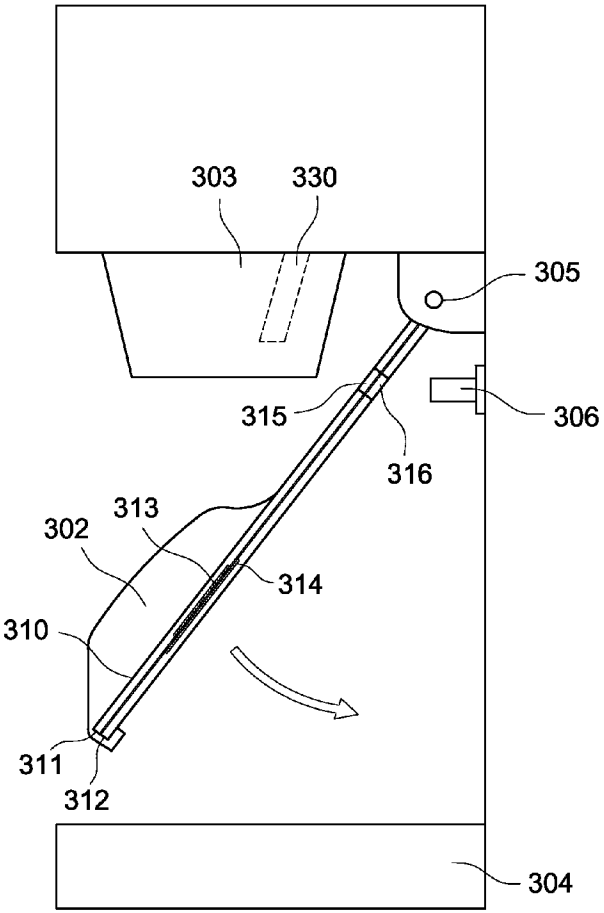

FIGS. 3*a* and 3*b* disclose a dispenser 300 according to an example embodiment. The dispenser 300 may include a control panel 301 having a display 307 and/or a mode button 308, a chute 303 and water spout 330 beneath the control panel 301, and a spill tray 304 beneath the chute 303. A paddle 302 extends underneath the chute 303 as well, and may be connected via a hinge 305. The hinge 305 may be biased away from the rear wall of the dispenser 300 and a sensor 306 may detect when the paddle 302 is pressed toward the rear wall of the dispenser 300.

Paddle 302 may include a display 310 for indicating a mode of the dispenser. The display may include panels 311, 312 in a layered arrangement. The panels 311, 312 may define front and back surfaces and one or more edge surfaces defining a perimeter of the front and/or back surfaces. The panels 311, 312 may be made of acrylic or other material and may be transparent, translucent and/or opaque in one or more directions. For example, the panels 311, 312 may be textured such that each is transparent between its edges and is translucent between the front and back surfaces. Alternatively, a transparent, translucent or opaque layer, portion or design, e.g., via etching, may be provided in one or more directions between the various surfaces, allowing for a variety of design and lighting arrangements both for the paddle display 310 and for the area around the display 310.

In the example embodiment of FIGS. 3*a* and 3*b*, the display 310 comprises respective front and rear acrylic panels 311, 312. Front panel 311 includes an etched pattern 313 and a front facing LED 315 arranged to illuminate the panel 311 in an edge direction and which may also illuminate a portion of the dispenser 300. It should be noted that in this and other embodiments, the pattern need not be etched to allow light to reflect out in a predetermined pattern. A variety of surface or subsurface treatments, such as a painted or coated surface revealing the pattern, may be used to display the desired pattern. Likewise, rear panel 312 includes another etched pattern 314 in optical alignment relative to the etched pattern 313 of front panel 311, and a rear facing LED 316 arranged to illuminate the panel 312 in an edge direction and which may also illuminate a portion of the dispenser 300.

One or both LEDs 315, 316 may also be configured to dim or cycle on and off in a specific pattern. For example, an LED may have a dimmer setting for low light situations where less illumination is necessary. Alternatively, an LED may fade on or off for a more aesthetically pleasing effect. The LED may also blink or otherwise cycle on and off in response to a status or condition, e.g., of the dispenser.

Figure 4B:
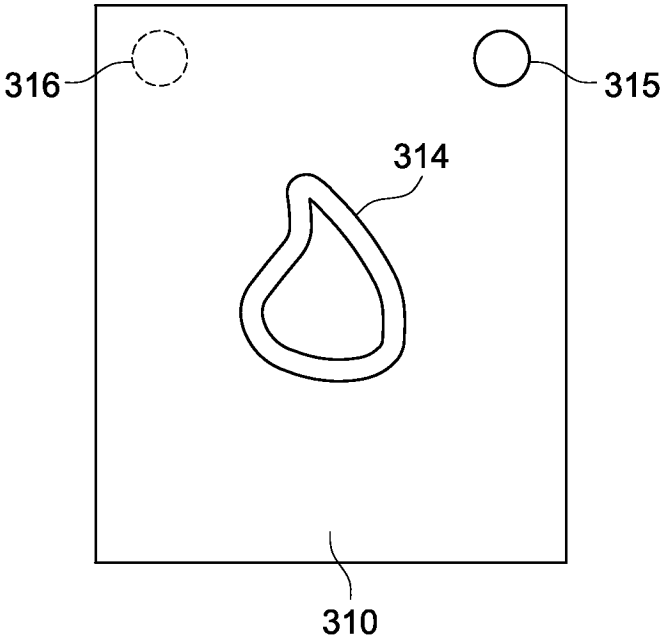
FIGS. 4*a*-4*c* illustrate three different modes of the display portion of the embodiment illustrated by FIGS. 3*a* and 3*b;*
Figure 4A:
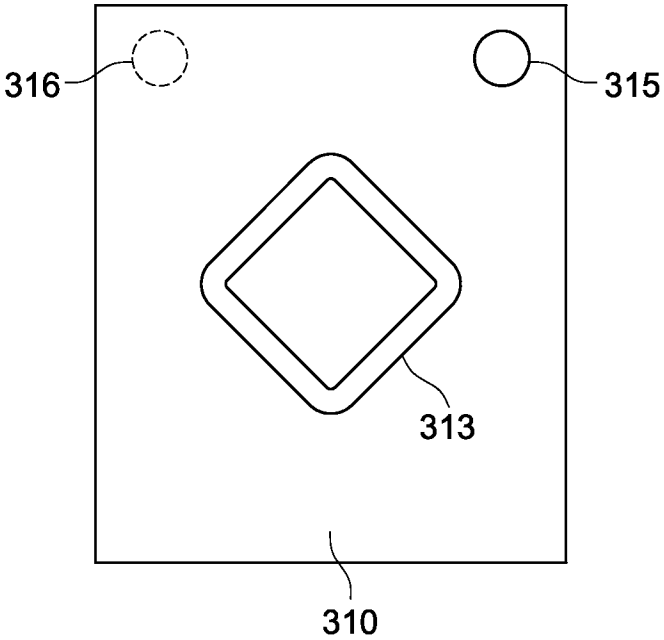
Figure 4C:
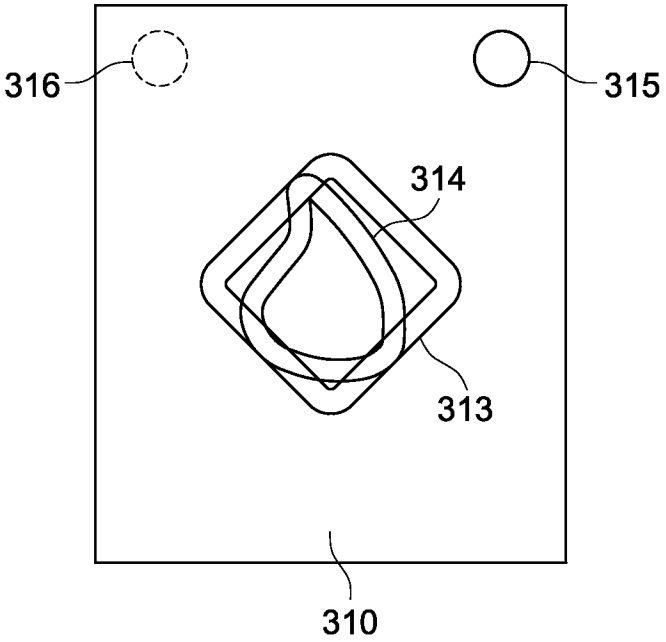

In this embodiment, the combination of two LEDs 315, 316 can be used to display three different modes, as shown in FIG. 4*a*-4*c*. For example, illuminating only the front etched pattern 313 via the front LED 315 may form an "ice cube" icon representing a cubed ice mode (as in FIG. 4*a*) while illuminating only the rear etched pattern 314 via the rear LED 316 may form a "water drop" icon representing a water mode (as in FIG. 4*b*). Illuminating both patterns 313, 314 simultaneously via both LEDs 315, 316 combines the patterns when viewed together into a "crushed ice" icon representing a crushed ice mode (as in FIG. 4*c*). As discussed above, the LEDs may also extend past the surfaces of their respective panels 311, 312 to illuminate the area around the paddle 302 as well. Thus, where the above described prior art dispenser 200 may require separate light sources for each of the three mode indicators of the control panel 201 and an additional light source 209 for the paddle area, the example described in FIG. 3 requires only two light sources to perform the same functions.

Figure 5A:
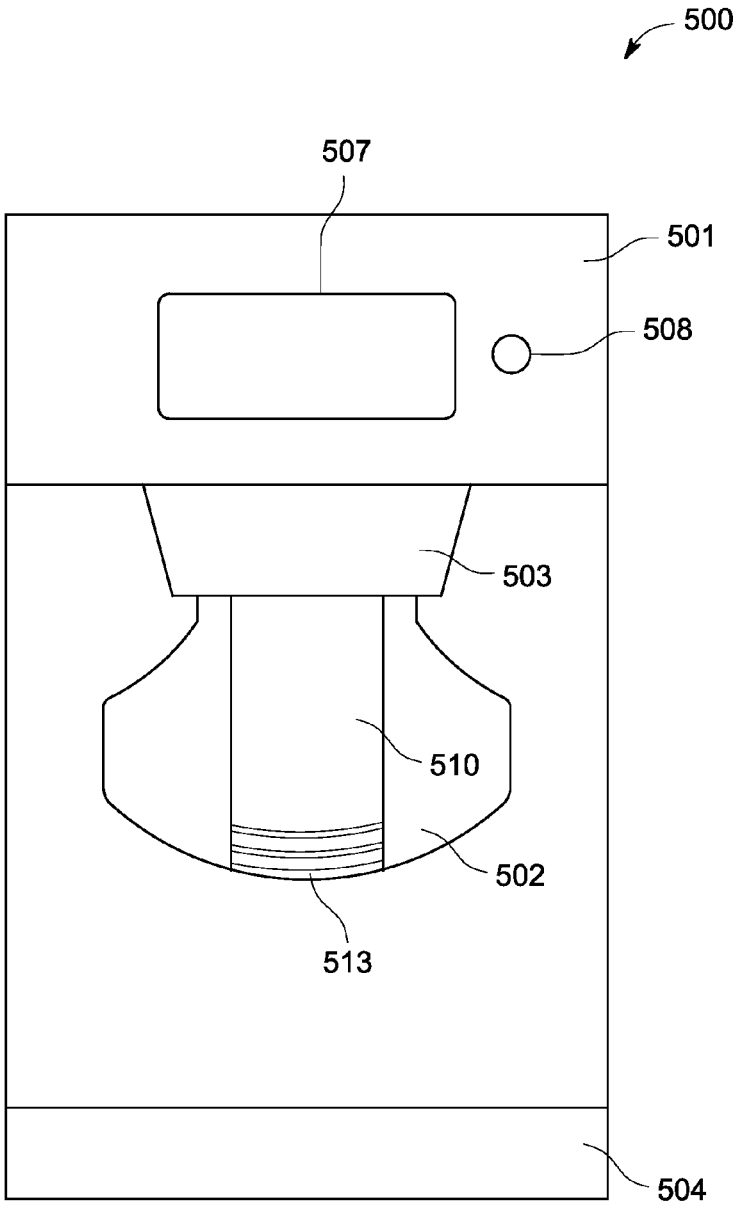
FIGS. 5*a* and 5*b* illustrate front and side views of a dispenser according to another example embodiment.
Figure 5B:
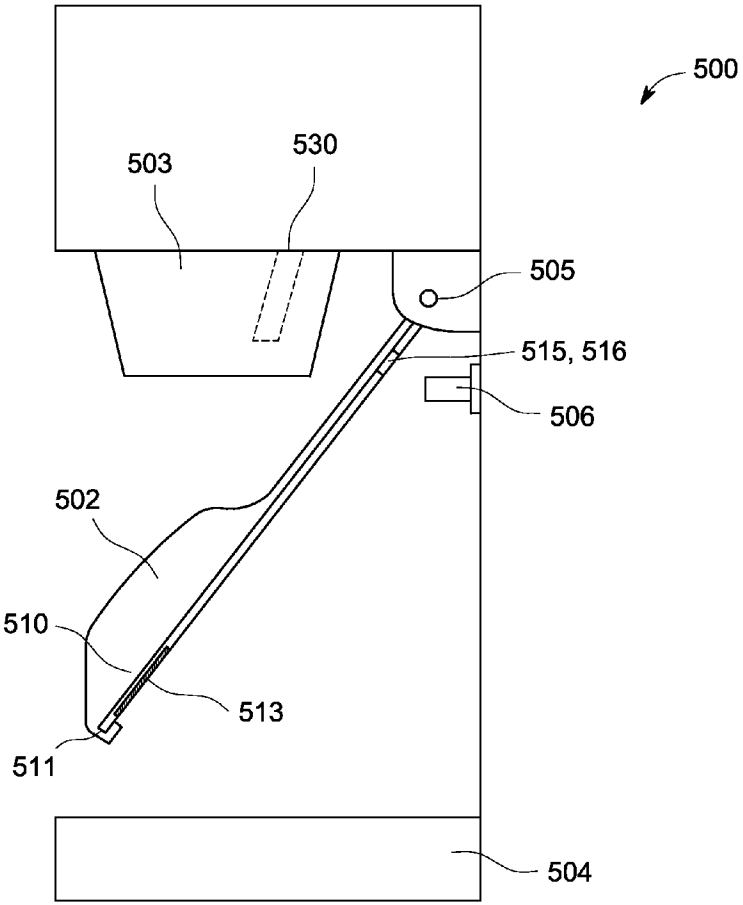

FIGS. 5*a* and 5*b* illustrate a dispenser 500 according to an alternative example embodiment. The dispenser 500 may include a control panel 501 having a display 507 and/or a mode button 508, a chute 503 and water spout 530 beneath the control panel 501, and a spill tray 504 beneath the chute 503. A paddle 502 extends underneath the chute 503 as well, and may be connected via a hinge 505. The hinge 505 may be biased away from the rear wall of the dispenser 500, and a sensor 506 may detect when the paddle 502 is pressed toward the rear wall of the dispenser 500.

Paddle 502 may include a display 510 for indicating a mode of the dispenser. In this embodiment, the display only includes a single panel 511 defining front and back surfaces and one or more edge surfaces defining a perimeter of the front and/or back surfaces. The panel 511 may be made of acrylic or other material and may be transparent, translucent and/or opaque in one or more directions. For example, the panel may be textured such that it is transparent between its edges and is translucent between the front and back surfaces. Alternatively, a transparent, translucent or opaque layer, portion or design, e.g., via etching, may be provided in one or more directions between the various surfaces, allowing for a variety of design and lighting arrangements both for the paddle display 510 and for the area around the display 510.

In the example embodiment of FIGS. 5*a* and 5*b*, the display 510 comprises respective acrylic panel 511 having an etched pattern 513 and a pair of LEDs 515, 516 arranged to illuminate the panel 511 in an edge direction and which may also illuminate a portion of the dispenser 500. In this embodiment, the LEDs 515, 516 are rear facing, but they may be arranged differently, e.g., front facing, alternating, in other embodiments. In this embodiment, the LEDs 515, 516 are different colors in order to present three different color combinations for the three different modes. For example, LED 515 may be blue, to be illuminated by itself when the dispenser 500 is in a water mode. LED 516 may be yellow, to be illuminated by itself when the dispenser 500 is in a cubed ice mode. Accordingly, illuminating both LEDs 515, 516 combine the two light sources into a green light source and may indicate a crushed ice mode. In an alternate embodiment, a single multi-color LED may be used in place of one or more LEDs 515, 516. Similarly, allowing each of the LEDs 515, 516 to also illuminate the area of the dispenser 500 around the paddle 502 will allow a user to view the specific color shade and thus determine the dispenser mode from farther away as the user approaches the dispenser, as well as providing a light source to the user.

Figure 6A:
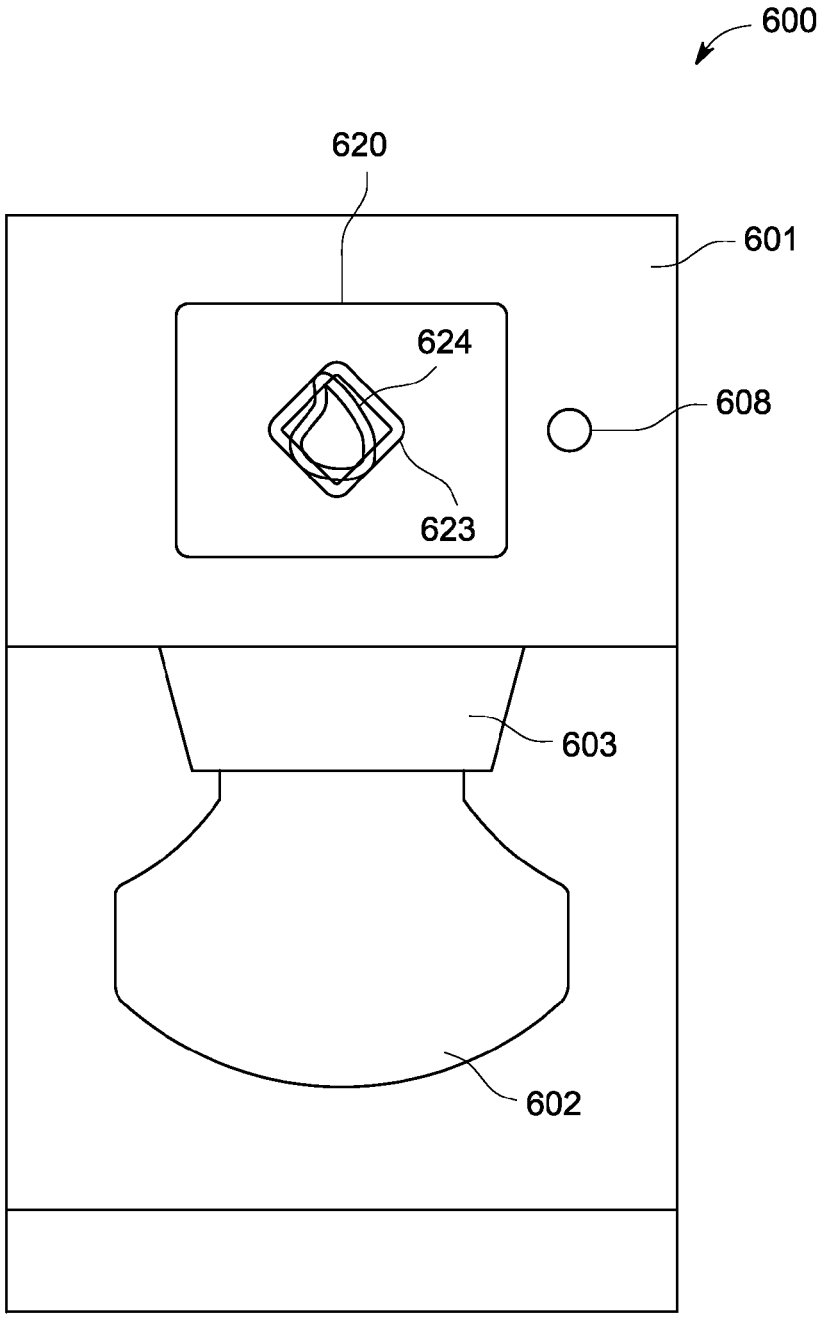
FIGS. 6*a* and 6*b* illustrate front and side views of a dispenser according to another example embodiment.
Figure 6B:
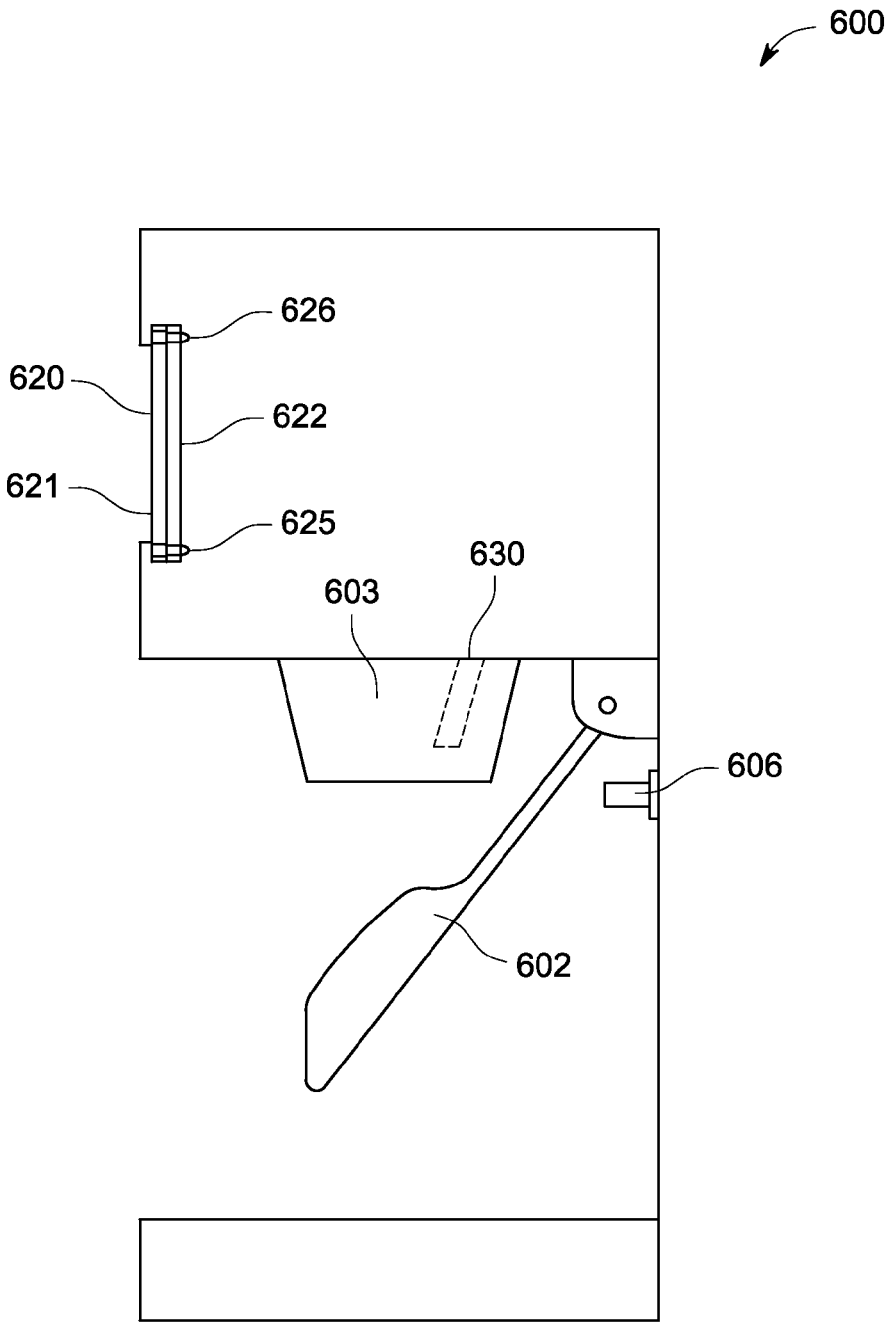
Figure 7:
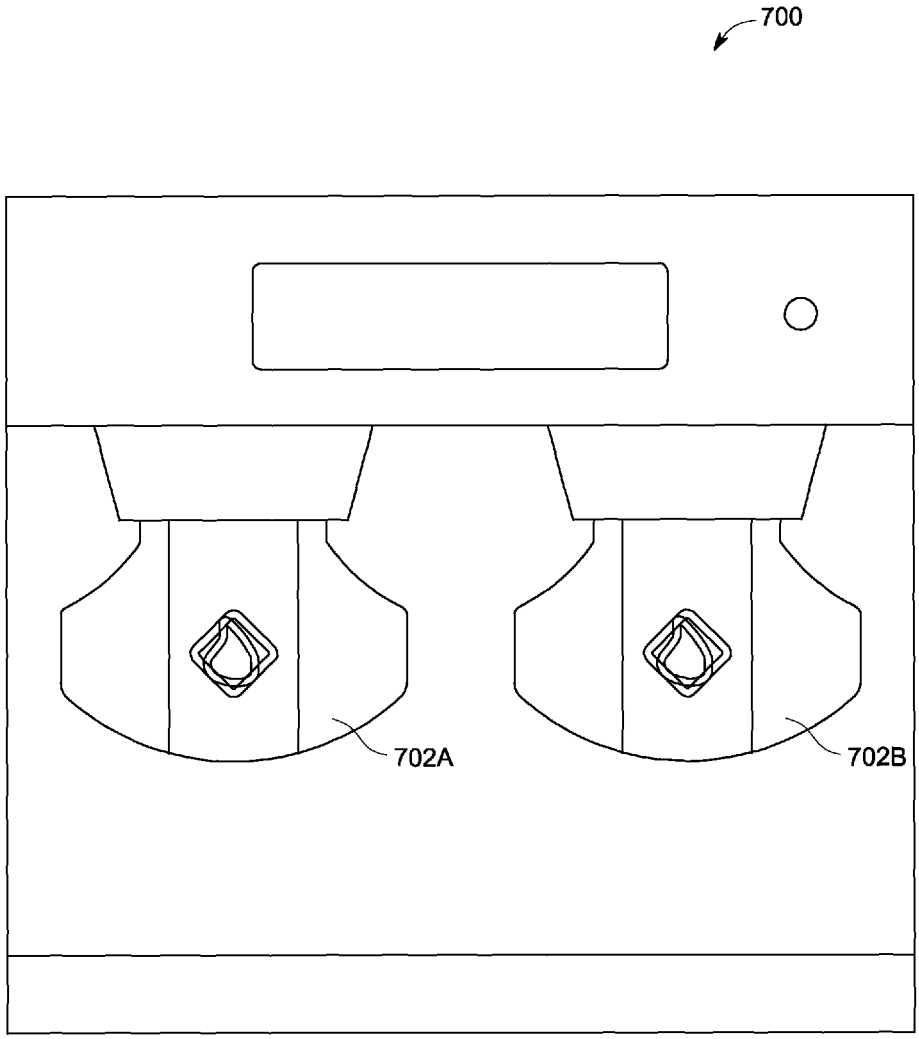
FIG. 7 shows a dispenser with two paddles.

FIGS. 6*a* and 6*b* illustrate another example embodiment. A dispenser 600 may include a control panel 601 having a display 620 and/or a mode button 608, a chute 603 and water spout 630 beneath the control panel 601, and a spill tray 604 beneath the chute 603. A paddle 602 extends underneath the chute 603 as well, and may be connected via a hinge 605. The hinge 605 may be biased away from the rear wall of the dispenser 600 and a sensor 606 may detect when the paddle 602 is pressed toward the rear wall of the dispenser 600.

In this embodiment, display 620 indicates a mode of the dispenser. The display 620 may include panels 621, 622 in a layered arrangement. The panels 621, 622 may define front and back surfaces and one or more edge surfaces defining a perimeter of the front and/or back surfaces. The panels 621, 622 may be made of acrylic or other material and may be transparent, translucent and/or opaque in one or more directions. For example, the panels 621, 622 may be textured such that each is transparent between its edges and is translucent between the front and back surfaces. Alternatively, a transparent, translucent or opaque layer, portion or design, e.g., via etching, may be provided in one or more directions between the various surfaces, allowing for a variety of design and lighting arrangements both for the display 620 and for the area around the display 620.

In the example embodiment of FIGS. 6*a* and 6*b*, the display 620 comprises respective front and rear acrylic panels 621, 622. Front panel 621 includes an etched pattern 623 and a front facing LED 625 arranged to illuminate the panel 621 in an edge direction. Likewise, rear panel 622 includes another etched pattern 624 in optical alignment relative to the etched pattern 623 of front panel 621, and a rear facing LED 626 arranged to illuminate the panel 622 in an edge direction.

In many embodiments, multiple paddles and other elements may be used. For example, a first paddle may be used for dispensing ice, while a second paddle may be used adjacent to the first paddle may employ a separate spout for dispensing water. Each paddle may employ portions of the lighting and display schemes described above with respect to other embodiments.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An indicator for a dispenser, comprising:

at least one display layer comprising a plurality of stacked display layers each having:

at least one display surface surrounded by at least one edge surface, the at least one layer being transparent in a direction of the at least one edge surface;

at least one light source configured to transmit light through the at least one display layer in the direction of the at least one edge surface; and at least one pattern portion disposed in the at least one display surface such that light from the at least one light source is redirected through the at least one pattern portion, wherein illuminating a first display layer and not illuminating a second display layer displays a first composite pattern representing a first operational state of the dispenser, wherein illuminating the second display layer and not illuminating the first display layer displays a second composite pattern representing a second operational state of the dispenser, and wherein simultaneously illuminating the first and second display layers displays a third composite pattern representing a third operational state of the dispenser.

2. The indicator of claim 1, wherein the indicator is disposed in at least one paddle configured to activate the dispenser.

3. The indicator of claim 1, wherein the at least one display layer is formed of acrylic.

4. The indicator of claim 1, wherein each at least one pattern of each respective display layer is arranged within the same predetermined region in each respective display layer.

5. The indicator of claim 1, wherein the at least one light source comprises an LED.

6. A dispenser for a refrigerator, comprising:

at least one indicator comprising:

at least one display layer comprising a plurality of stacked display layers each having:

at least one display surface surrounded by at least one edge surface, the at least one display layer being transparent in a direction of the at least one edge surface;

at least one light source configured to transmit light through the at least one display layer in the direction of the at least one edge surface; and at least one pattern portion disposed in the at least one display surface such that light from the at least one light source is redirected through the at least one pattern portion, wherein illuminating a first display layer and not illuminating a second display layer displays a first composite pattern representing a first operational state of the dispenser, wherein illuminating the second display layer and not illuminating the first display layer displays a second composite pattern representing a second operational state of the dispenser, and wherein simultaneously illuminating the first and second display layers displays a third composite pattern representing a third operational state of the dispenser.

7. The dispenser of claim 6, wherein the dispenser is a water and ice dispenser.

8. The dispenser of claim 7, wherein the dispenser comprises at least one paddle for dispensing at least one of ice and water.

9. The dispenser of claim 8, wherein the at least one paddle comprises a first paddle for dispensing ice, and a second paddle for dispensing water.

10. The dispenser of claim 9, wherein the at least one indicator is disposed in at least one of the first and second paddles.

11. The dispenser of claim 8, wherein the at least one indicator is disposed in the at least one paddle.

12. A refrigerator comprising:

a dispenser; and an indicator for the dispenser comprising:

a display layer comprising a plurality of stacked display layers each having:

a display surface surrounded by an edge surface, the displayer layer being transparent in a direction of the edge surface;

a light source configured to transmit light through the display layer in the direction of the edge surface; and a pattern portion disposed in the display surface such that light from the light source is redirected through the pattern portion, wherein illuminating a first display layer and not illuminating a second display layer displays a first composite pattern representing a first operational state of the dispenser;

wherein illuminating the second display layer and not illuminating the first display layer displays a second composite pattern representing a second operational state of the dispenser; and wherein simultaneously illuminating the first and second display layers displays a third composite pattern representing a third operational state of the dispenser.

13. The refrigerator of claim 12, wherein the dispenser is a water and ice dispenser.

* * * * *